US005452968A

United States Patent [19]

Dlugosz

[11] Patent Number: 5,452,968

[45] Date of Patent: Sep. 26, 1995

[54] CEMENT-CONTAINING CONSTRUCTION ROPES AND APPLICATIONS THEREFOR

[76] Inventor: Leonard T. Dlugosz, 4 Minden Dr., Orchard Park, N.Y. 14127

[21] Appl. No.: 41,719

[22] Filed: Apr. 1, 1993

[51] Int. Cl.[6] ..... E02D 5/00; E04H 17/16; F23H 13/00

[52] U.S. Cl. ..... 405/303; 126/152 R; 256/24; 405/258

[58] Field of Search ..... 405/18, 19, 222, 405/258, 259.5, 259.6, 303; 52/2.15, 596, 743, 744, DIG. 2; 126/152 R; 256/24

[56] References Cited

U.S. PATENT DOCUMENTS

| | | | |
|---|---|---|---|
| 2,042,870 | 6/1936 | Stafford | 52/596 X |
| 3,342,033 | 9/1967 | Crouch et al. | 52/744 X |
| 3,425,228 | 2/1969 | Lamberton | 405/18 |
| 3,561,219 | 2/1971 | Nishizawa et al. | 405/19 |
| 3,570,254 | 3/1971 | Turzillo | 405/18 |
| 3,922,832 | 12/1975 | Dicker | 405/18 X |
| 4,096,944 | 6/1978 | Simpson | 206/219 |
| 4,395,162 | 7/1983 | Murphy et al. | 405/261 |
| 4,399,911 | 8/1983 | Murphy et al. | 206/219 |
| 4,420,275 | 12/1983 | Ruser | 405/18 X |
| 4,486,121 | 12/1984 | Thompson et al. | 405/18 X |
| 4,516,884 | 5/1985 | Douty | 405/261 |
| 4,940,364 | 7/1990 | Dlugosz | 405/229 |

FOREIGN PATENT DOCUMENTS

| | | | |
|---|---|---|---|
| 156826 | 8/1985 | Japan | 405/18 |

*Primary Examiner*—David H. Corbin
*Attorney, Agent, or Firm*—Howard M. Ellis

[57] ABSTRACT

Flexible concrete structures resemble elongated rope-like articles having an outer textile casing in the form of a mono-tubular body with a continuous inner bore filled with dry cementitious material. The concrete ropes are naturally permeable to water for controlled chemical hydration for maximizing structural values and load bearing properties. The flexible concrete ropes may be employed in a wide range of applications in masonry and cement construction, such as caulk filler between foundations and roadways; as convenient mortar ropes in the reinforcement and stabilization of stone, rock, brick and block structures, like culvert bridges, drainage ditches, railroad roadbeds; temporary templates for A-frame structures, and as chocks for dry foundations. Flexible concrete rope articles can be wetted and woven into grids and lattice structures for use as fencing, gates, grids for fireplaces and grills or fabricated into subterranean anchoring supports for posts and signs for the elimination of large amounts of pourable concrete normally required.

25 Claims, 4 Drawing Sheets

FIG. 9
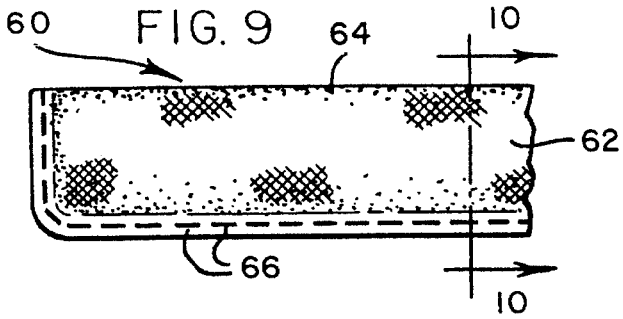
FIG. 10
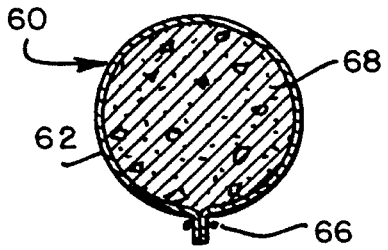
FIG. 14
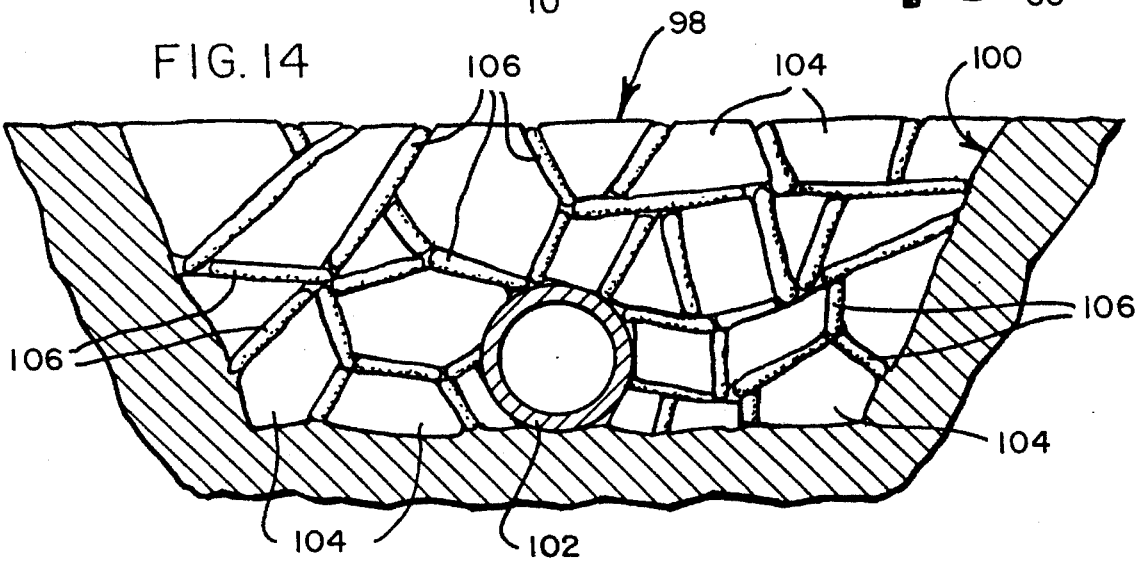
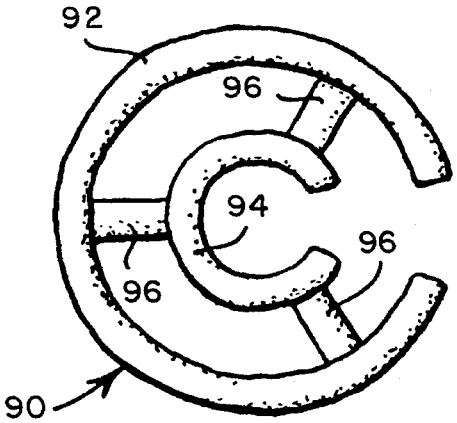
FIG. 13
FIG. 15
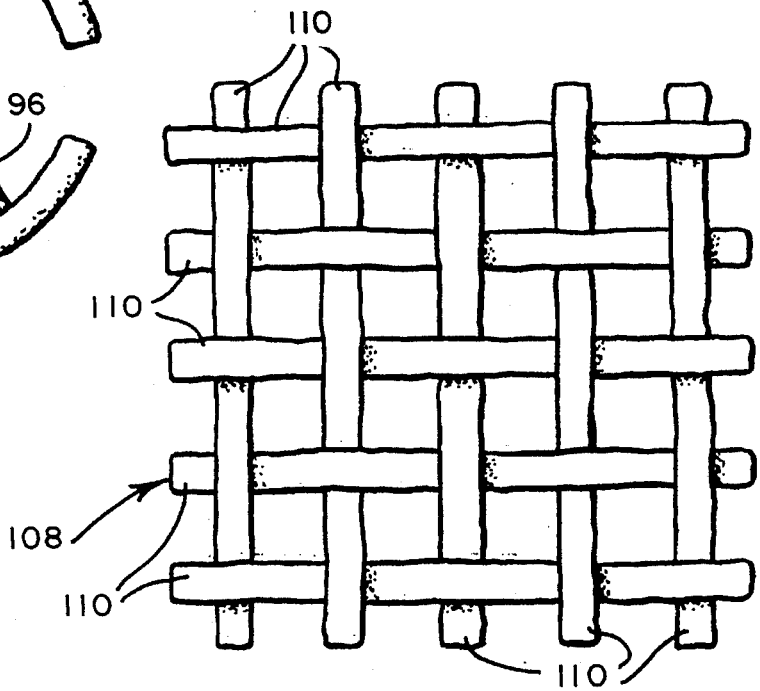

CEMENT-CONTAINING CONSTRUCTION ROPES AND APPLICATIONS THEREFOR

TECHNICAL FIELD

The present invention relates generally to improved construction materials and useful applications therefor, and more specifically, to flexible, highly versatile cement-containing elongated rope-like articles which can be used in fabricating useful objects or employed as high strength reinforcements, gap fillers, and the like in masonry and concrete construction.

BACKGROUND OF THE INVENTION

Mono-tubular, naturally water porous textile casings have their bores filled with dry cementitious material, such as concrete or mortar mix, and resemble generally thin, flexible rope-like articles which can have lengths of up to 3000 cm or more. The cement-containing flexible rope-like articles provide a novel, highly economic and improved material of construction, as well as being suitable in fabricating useful articles of commerce. That is, the flexible rope-like structures can be employed in a wide range of applications in masonry and cement construction, such as caulking filler between foundations and driveways; as convenient mortar ropes in the reinforcement of stone, rock, brick and block structures, like culvert bridges, drainage ditches, railroad roadbeds; as temporary templates or skeletons for A-frame structures, or as chocks for dry foundations in areas which might be inaccessible to ready-mix concrete trucks, to name but a few.

Similarly, the cement-containing flexible rope-like articles can be wetted and woven into grid or lattice structures for use as fencing, gates, grids for outdoor fireplaces and grills or fabricated in-situ into subterranean anchoring supports for posts, poles and signs for the elimination of large amounts of pourable concrete normally required. The cement-containing flexible rope-like articles likewise can be fashioned into art forms for interior decorations, e.g. artificial plants and architectural designs like window shutters and doors to reflect a rustic or contemporary art form.

In the fields of masonry and concrete construction it is customary to employ mortar mixes in bonding brick and stone structures. Unlike concrete tradesmen, bricklayers and stone masons require greater time intervals for laying a course of bricks or blocks. To achieve this end, conventional mortar mixes rely on formulations which include inter-alia higher water concentrations than with poured concrete. This allows for a "soft" or wetter consistency to assure that the mortar remains in a workable or plastic state for longer intervals. Hence, concrete mixes which set-up much sooner are usually unsuitable for use as mortars, grouts and filler/caulking applications in reinforcing and bonding brick, block, stone, etc.

While it would be desirable to employ concrete in place of conventional mortars in certain types of construction because of its greater compressive strength and structural values the shorter set-up times associated with hydrated concrete make it impractical in most instances for use as mortar. Additional water and/or retardants might be added to concrete mixes to increase set-up time intervals, but this would result in trade-offs in structural values and strength. Accordingly, it was discovered that the cement-containing flexible rope-like mono-tubular bodies disclosed herein comprising outer textile casings which are naturally permeable to water for controlled chemical hydration advantageously permit less water to be used in hydrating the cementitious material while also increasing the time interval for setting-up. It was found that the water permeable textile casings provide less exposure of the hydrated cementitious material to ambient air conditions, and concomitant slower evaporation of moisture therefrom. Hence, the flexible rope-like articles permit the use of maximum strength concrete in place of lesser strength mortars, to provide useful mortar-like materials with greater structural values.

Others have attempted to fabricate tubular-like articles filled with cementitious material. For example, U.S. Pat. No. 4,096,944 to Simpson discloses a grouting cartridge for an anchoring device fabricated with a frangible outer tubular casing filled with cement powder and water containing microcapsules. The cement powder is hydrated when an anchoring element pierces the non-porous casing and fractures the microcapsules dispersed in the powder. U.S. Pat. No. 4,516,884 to Douty also discloses a grouting cartridge which relies on the use of pressure sensitive liquid-containing capsules for hydrating a dry cement interior.

U.S. Pat. No. 4,395,162 to Murphy et al disclose another type of anchoring cartridge which employs an impermeable outer casing filled with cement. In order to hydrate the cement the cartridge per se must be perforated. Murphy et al disclose a modified anchoring cartridge in U.S. Pat. 4,399,911 wherein a porous tube is required to be inserted into a liquid impermeable casing to wet the grouting mix inside.

Accordingly, there is a need for a more economical, convenient to use and versatile cement-containing flexible rope-like article which can be hydrated without costly mechanisms, and which can be fabricated with an outer casing which is naturally permeable to water for controlled hydration of the cementitious material packaged in the interior for maximizing strength and structural properties.

SUMMARY OF THE INVENTION

Accordingly, it is a principal object of the invention to provide for novel, highly versatile cement-containing flexible rope-like construction materials for use in fabricating a broad range of useful articles. They may also be employed as high strength reinforcement and bonding agents, and as gap type fillers, such as mortar rope, caulking rope, and the like, in masonry and concrete construction, and particularly, in reinforcing and stabilizing stone, rock, broken concrete pieces, brick and/or block construction.

It is therefore a primary object of the invention to provide for cement-containing flexible rope-like construction materials having elongated outer textile casings in the form of mono-tubular bodies with a continuous single bore running therethrough. The mono-tubular bodies are filled with dry cementitious material. Significantly, the elongated outer textile casings are naturally permeable to water for controlled chemical hydration or wetting of the cementitious material.

For purposes of this invention, the expression "cementitious material" is intended to include any of the commonly used dry cement-containing concrete and mortar mixes. More specifically, in the case of concrete mixes this would mean cement and aggregate, like natural sands and gravel, including crushed stone, and any of the light weight aggregates manufactured from clays, shales, slates and slag, particularly for improved thermal and acoustical insulating properties. For optimum strength and structural values a greater proportion of stone aggregate would be used. Mortar types are intended to include the so called straight lime mortars, but also straight cement mortars, cement-lime mortars, as well as lime-pozzolana mortars in relative proportions by volume of cement to lime to sand ranging from about 1:¼:3 to about 1:4:15.

As previously mentioned, the outer textile casings are naturally permeable to water for controlled chemical hydration of the cementitious material. Unlike certain earlier cement encased materials, the outer casings of the immediate invention do not require perforation or crushing in order to hydrate the dry cementitious material. In other words, —naturally permeable to water for controlled chemical hydration—is intended to denote the textiles employed in fabricating the casings are inherently porous to water and upon soaking the casings allow sufficient amounts of moisture to pass into the interior without manually perforating, crushing, etc., to fully hydrate the dry concrete, usually without flooding for maximum overall strength and load bearing properties with curing. In cases of protracted soaking of the cement-filled casings release of excess water can be expedited with application of compressive force.

It is yet a further object of the invention to provide cement-containing rope-like articles of construction which are highly flexible and can be manually shaped into virtually any desired shape. This characteristic lends to the broad range of useful applications for these articles of construction. For example, lengths of the cement-containing flexible rope-like structures can be hydrated and assembled on-site into a substantially planar or flat style subterranean supporting aids for vertically positioned posts, poles and signs. Similarly, transverse pairs of the concrete rope can be prefabricated into subterranean supports by hydrating and weaving into an interlaced pattern, and curing into a rigid structure. This would include prefabricated and rigid (cured) subterranean supports, for example, having a generally outer rounded body, a post engaging hub substantially centrally positioned relative to the outer rounded body with spokes connecting the hub and outer rounded body into a unitized structure.

The present invention also includes as a further object methods for subterranean reinforcement of posts, which is intended to include in addition to posts, poles and signs and similar type vertical structures implanted into the ground by the steps of:

(a) providing an in-ground hole with a greater diameter than that of the post;

(b) forming a first subterranean support in the lower tier of the in-ground hole by hydrating cement-containing flexible rope-like articles and shaping into a grid with an aperture for engaging the post;

(c) engaging the post and post aperture of the grid while adjusting the dimensions of the aperture for firm engagement of the post;

(d) partially back filling the in-ground hole with soil and tamping to compress the soil against the first support to provide anchoring and resistance against lateral forces, (e) forming at least one further grid support in the in-ground hole around the post at a second tier above the first support by repeating steps b–d, and (f) back filling the in-ground hole with additional soil and tamping.

The instant invention also contemplates other articles fabricated into structures having an interlaced or woven pattern, such as fence panels, gates, fireplace and grill grates. The latter being fabricated with the hydrated flexible cement-containing rope-like articles containing concrete mixes having at least one additive for enhanced thermal properties. This would especially include the addition of fire clay to the concrete mix.

It is yet a further object of the invention to provide means for reinforcing and stabilizing stone, rock, broken concrete pieces, brick and/or block construction with the cement-containing flexible rope-like articles as disclosed herein, particularly with mortar ropes formed with the cement-containing articles. This would include reinforcing bridging structures, such as stone sidewalls of culvert bridges linking driveways to main roadways, reinforcing sidewalls of drainage ditches, etc. Accordingly, it is still a further object of the invention to provide methods of reinforcing bridging structures fabricated with stone, rock, broken concrete pieces, brick and/or block by the steps of:

(a) providing a masonry mortar rope-like article comprising an outer textile casing naturally permeable to water and filled with a dry cementitious material selected from the group consisting of concrete mix and mortar mix;

(b) cutting lengths of the masonry mortar rope to fit in crevices and joints between adjacent stones, boulders, rocks, broken concrete pieces, bricks and/or blocks, and (c) hydrating a cut length of the masonry mortar rope and wedging in the crevices and joints.

These and other objects, features and advantages of the invention will become more apparent from the detailed written description below.

BRIEF DESCRIPTION OF THE DRAWINGS

FIG. 9 is a fragmented view of a further embodiment of cement-containing rope having an outer cloth tubular covering formed by folding the cloth longitudinally on top of itself and seamed with a continuous stitch on two edges;

FIG. 10 is a transverse sectional view of the cement rope member taken along line 10—10 of FIG. 9;

FIG. 13 is an alternative configuration of cement-containing rope members precast for a subterranean post anchoring system;

FIG. 14 is a view of a culvert bridge containing a culvert pipe and filled with stone reinforced with masonry mortar ropes, and FIG. 15 is a top view of an outdoor fireplace or grill grate lattice fabricated with cement mix filled rope members of the invention.

DESCRIPTION OF THE PREFERRED EMBODIMENTS

Figure 1:
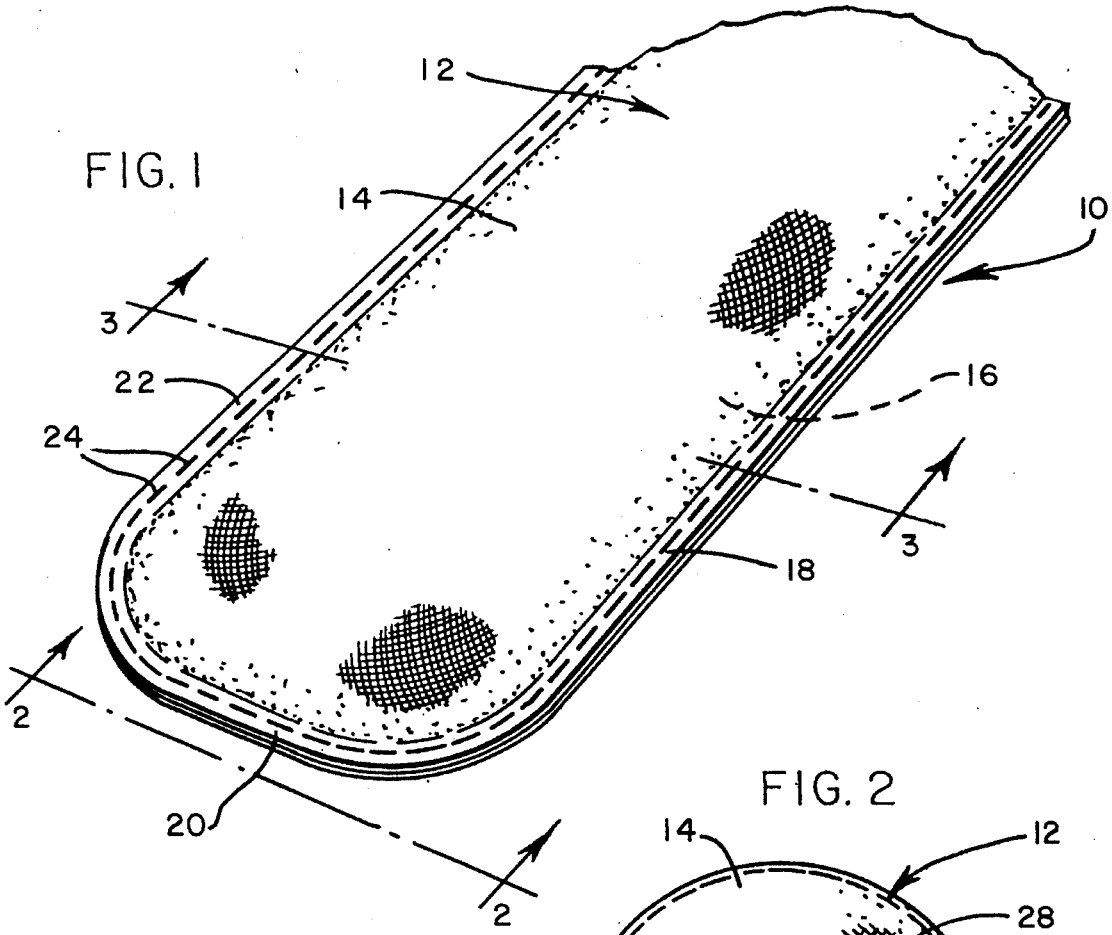
FIG. 1 is an enlarged perspective view of a partial length of one embodiment of cement-containing rope prior to wetting showing a two part outer porous covering stitched together along the entire peripheral edge.
Figure 2:
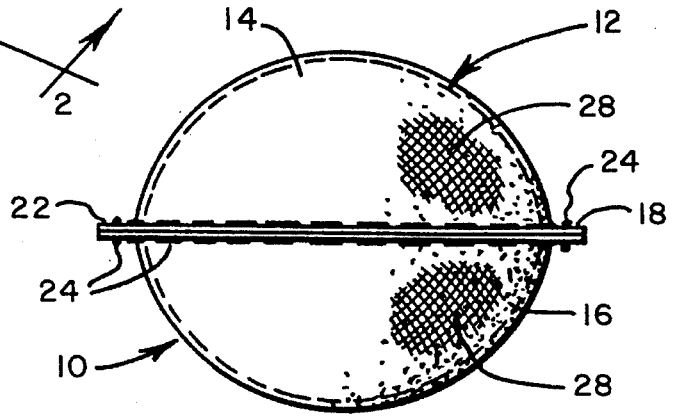
FIG. 2 is an end view of the cement-containing rope taken along line 2—2 of FIG. 1.
Figure 3:
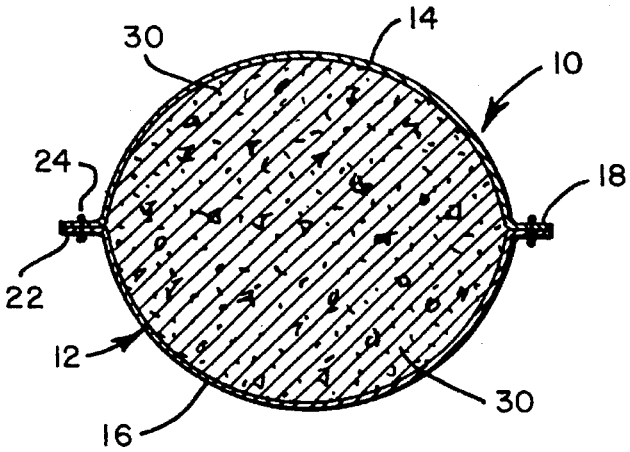
FIG. 3 is a sectional view of the rope showing the inner cementitious mix taken along line 3—3 of FIG. 1.

Turning first to FIG. 1, there is shown a partial view of a first embodiment of cement-containing flexible rope-like construction unit 10. The relatively narrow flexible rope-like structures, hereinafter referred to as "concrete rope", taken transversely have a generally rounded to oval configuration as best illustrated by FIGS. 2 and 3. That is, prior to wetting the dry units assume more of a rounded configuration, but upon hydration have a tendency to flatten-out somewhat and assume an oval shape.

Diameters of the concrete ropes for most applications range from approximately 1.25 cm to about 7.5 cm. Most useful lengths of the flexible mono-tubular concrete ropes are 15 cm, 30 cm and 46 cm. However, they can be fabricated in lengths of up to 30 meters or more for dispensing from large rolls wound onto reels, for use at construction sites. Required lengths of concrete rope prior to hydration can be severed with minimum effort. Cut ends of the cement-containing ropes can be conveniently closed by stapling, application of twistable retaining wires, or other equivalent closure means known in the art, to avoid loss of the cement mix at severed ends.

One embodiment of concrete rope 10 is comprised of a generally tubular shaped outer cloth casing 12 consisting of first and second panels 14 and 16. Preferably, panels 14 and 16 are seamed together at edges 18, 20 and 22 by continuous stitches 24. Hence, FIGS. 1–2 and 3 illustrate but one embodiment of the concrete ropes wherein outer casing 12 is comprised of a plurality of elongated panels fastened together along parallel seams to form single or mono-tubular elongated hollow bodies suitable for filling and holding a dry cementitious material, previously described.

Figure 4:
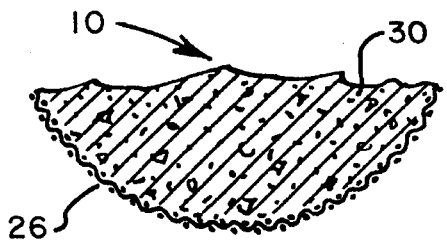
FIG. 4 is sectional fragmented view of the cement-containing rope highlighting the porous weave characteristics of the outer cloth covering.

The elongated mono-tubular cloth casings may be formed from various single and double ply woven and non-woven relatively lightweight fabrics. This would include durable cottons, jute, hemp, duck, light weight canvas, and the like, as well as synthetics and blends of natural and synthetic fibers, like cotton and polyester blends. Woven cottons, however, like muslin are especially preferred because of their durability, wettability properties and low cost. The weave 26 (FIG. 4 showing warp and filling threads) of the cloth casings preferably is sufficiently close as to permit storage and shipping without loss of any significant amounts of cementitious material from casing interiors prior to hydration especially during shipping, handling and storing. Most importantly, cloth casings should have semi-permeable properties, or in other words, be mostly impermeable to dry cementitious materials so as to prevent any significant loss of mix by passing from the filled interior, while also allowing water to readily enter by passing through pores 28 (FIG. 2) in the cloth panels and into the interior compartment without requiring perforating manually prior to soaking. Hence, the cloth casings function similarly to the so called "perm-selective" type membranes which allow passage of only certain types of materials, i.e. permeable to water, but substantially impermeable to solid particulate material.

As best shown by FIG. 3, the interior of the mono-tubular casing is filled with a cementitious material 30, previously described. Casing interiors are substantially completely filled with cementitious material 30, normally without leaving voids or open areas which can permit excess water entering during hydration to flood the interior of the casing. The objective is to achieve "controlled chemical hydration" for sufficient, but limited wetting of the cementitious material so as to maximize overall structural values and load bearing properties of the concrete rope with curing. With more porous type casings than previously described allowing passage of unlimited volumes of water into casing interiors then needed to achieve controlled chemical hydration the concrete ropes can lose important structural values and load bearing properties.

Figure 5:
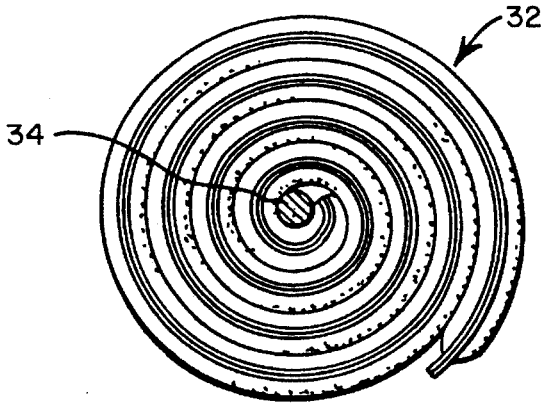
FIG. 5 is a side elevational view of a complete length of cement-containing rope prior to wetting showing its flexibility properties and ability to be wound on a centrally positioned carrier.

The filled concrete ropes of the invention are highly flexible prior to curing. This is readily demonstrated by FIG. 5 showing an extended length of concrete rope 32 wound on a centrally positioned rod member 34. Extended lengths can be readily wound on large dispensing reels, or other equivalent devices. The flexibility properties of the concrete ropes of the invention are particularly noteworthy as enabling a broad range of useful applications, previously discussed.

Figure 6:
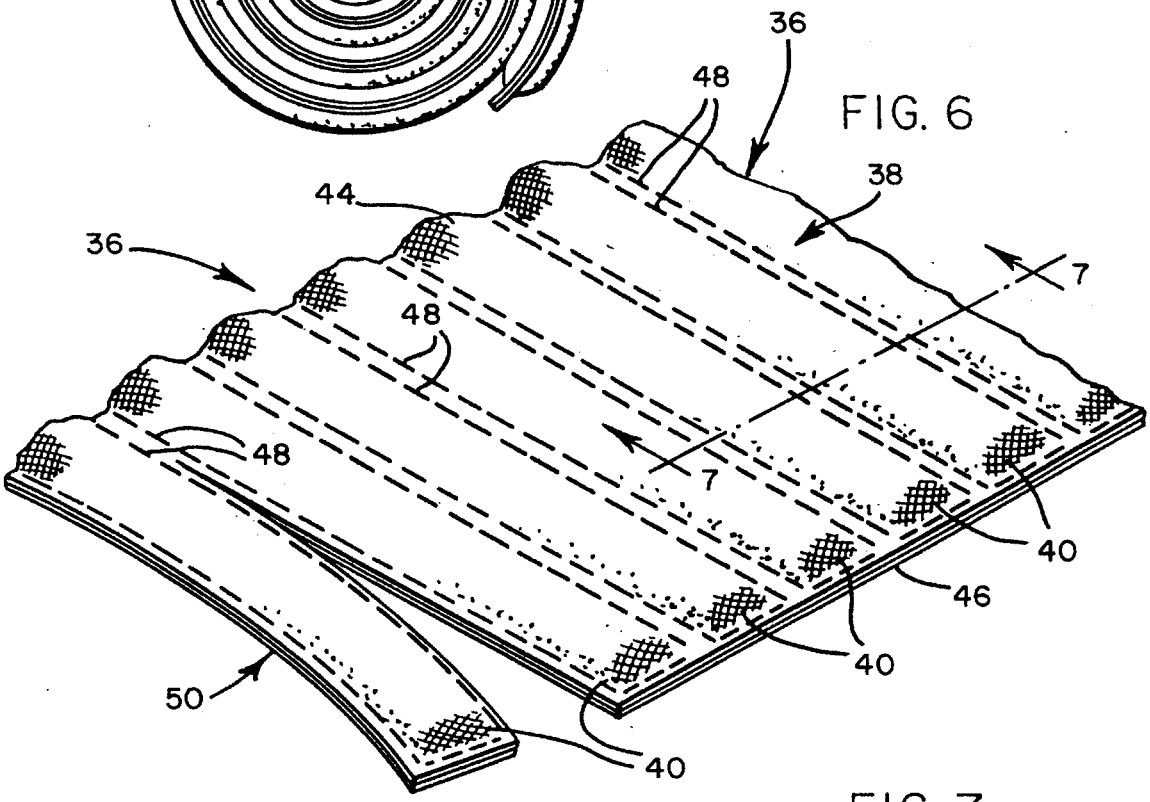
FIG. 6 is a partial, perspective view of a mat of connected cement-containing rope members with one end member partially severed from the mat.
Figure 7:
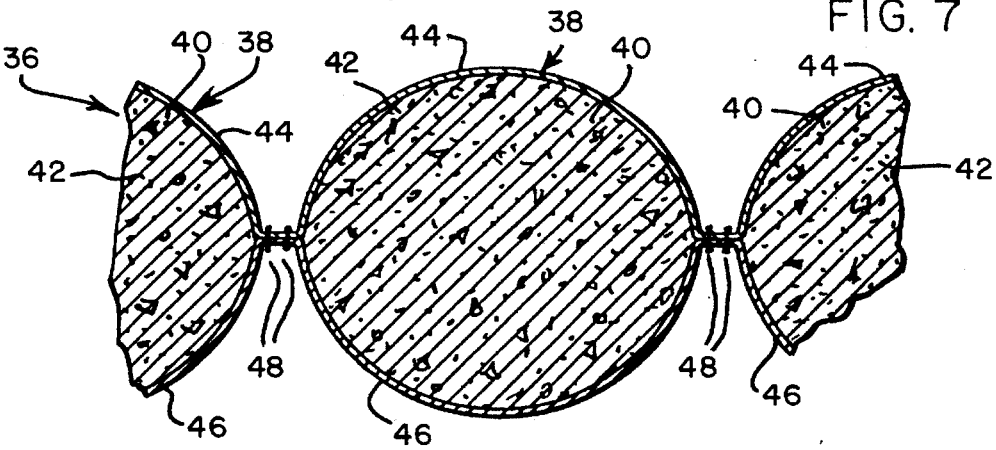
FIG. 7 is an enlarged fragmented sectional view of a mat of connected cement-containing rope members with spaced double stitching between individual rope members taken along line 7—7 of FIG. 6.

The mono-tubular concrete ropes of the type illustrated in FIG. 1 wherein the outer casing comprises a plurality of elongated cloth panels stitched together along parallel seams, may be conveniently fabricated from mat-like concrete filled structures 36 (FIGS. 6 and 7). Mat-like structure 36 consists of an outer shell 38 subdivided into a plurality of connected parallel tubular compartments 40. Each compartment 40 contains a sufficient amount of a dry cementitious material 42 to provide individual, longitudinally uniform, segregated concrete-containing bodies, connected into a unitized one-piece structure resembling a mat. Outer shell 38 of mat 36 comprises top and bottom panels 44 and 46 sewn together along parallel double seams 48 (FIG. 7) spaced from one another.

The one-piece mats and methods of making of the type of FIG. 6 are disclosed in detail by U.S. Pat. No. 4,940,364, the contents of which are incorporated-by-reference herein. The mats of FIGS. 6 and 7, however, are required to be prepared with double stitched seams 48. This allows individual mono-tubular concrete ropes 50 (FIG. 6) to be prepared by severing from one end of the mat by cutting the sewn shell between double seams 48. This provides an efficient and inexpensive mode for preparing the mono-tubular concrete ropes of FIG. 1. This method also provides the added flexibility, if desired, to prepare double or triple width concrete ropes by severing from mat 36, a rope unit consisting of two or three connected parallel tubular compartments 40 of the mat.

Figure 8:
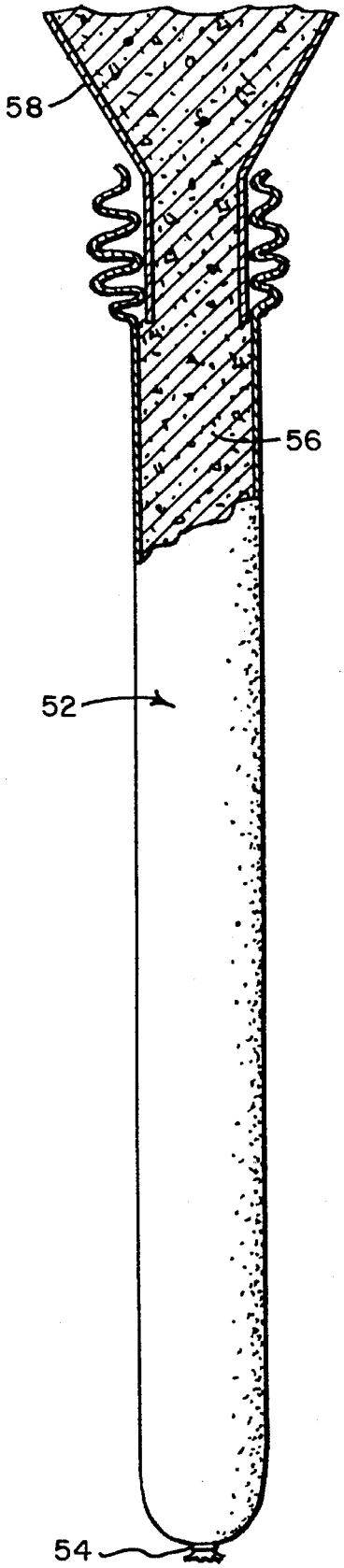
FIG. 8 is an elevational view of a further embodiment of cement-containing rope having a seamless outer cloth covering being filed with dry mix.

As an alternative embodiment, the present invention also contemplates flexible mono-tubular concrete ropes prepared with casings having seamless one-piece tubular cloth bodies 52 (FIG. 8). Seamless concrete ropes of the invention can have applied end-closure clips 54 of the type employed in the sausage making art, for example. The one-piece seamless tubular concrete ropes, or any of the mono-tubular casings disclosed herein, may be prepared by pouring dry cement-containing mix 56 in the open end of the casing using funnel means 58, for example, or automated filling equipment.

FIGS. 9 and 10 show a further embodiment of the mono-tubular concrete ropes of the invention with a single seamed tubular casing 60. This third embodiment consists of an outer casing fabricated from an elongated one-piece cloth panel 62 folded together without creasing, face-to-face centrally along edge 64 and sealed by stitching along one continuous edge 66 to form a closed mono-tubular cloth body suitable for filling with dry cementitious material 68. Hence, the concrete ropes may be prepared from one or two piece cloth panels. The one-piece panel may be a seamless casing or a casing with a single longitudinal seam.

Figure 11:
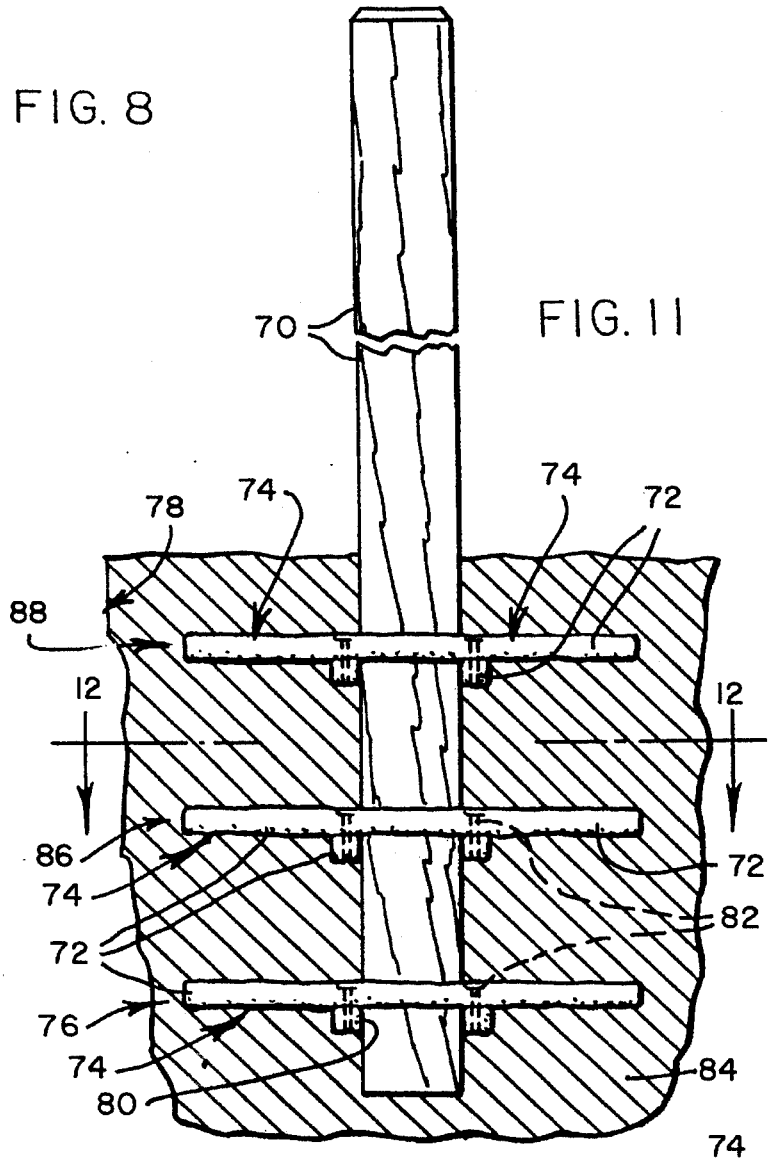
FIG. 11 is an elevational view of multiple cement-containing rope members being utilized for subterranean anchoring of a post in vertical position.
Figure 12:
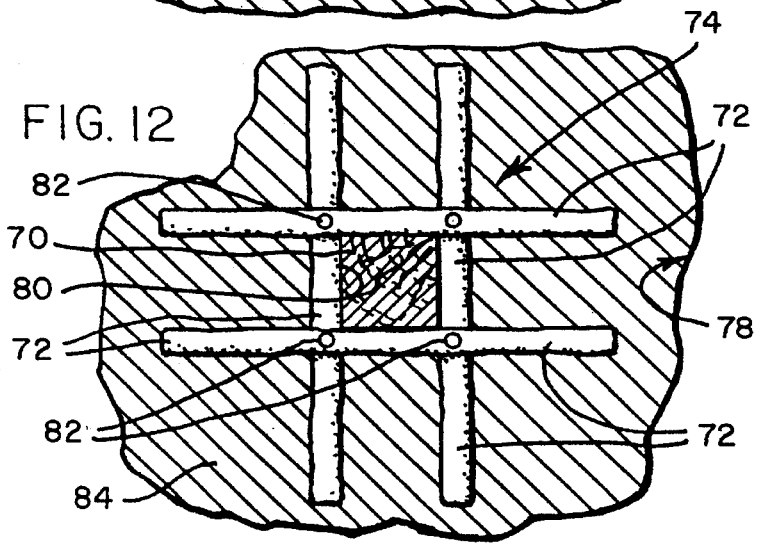
FIG. 12 is a top sectional view of the subterranean anchoring system employing a cross pattern of fastened cement ropes taken along line 12—12 of FIG. 11.

The concrete ropes of the invention have among their many useful applications subterranean supports for vertical anchoring of posts, poles, signs, and the like. FIGS. 11 and 12 illustrate a vertical post 70, such as used for supporting a mail box or sign. Instead of anchoring and reinforcing the post in an in-ground hole against vertical and lateral forces by surrounding with conventional poured concrete mix and curing, the concrete ropes can be used to form in-situ or by prefabrication a more economic support means, and less labor intensive method of supporting posts. Lengths of hydrated concrete rope 72 can be arranged into a planar grid structure 74 in lower tier 76 of in-ground hole 78. In one embodiment, cut lengths of concrete rope are wetted and by hand arranged into spaced pairs of flexible ropes with each pair being positioned in a plane running transverse to the other to provide a centrally positioned post aperture 80. A small amount of dry cement may be sprinkled between concrete ropes to enhance bonding together. While still moist and flexible pairs of concrete ropes can be fastened together with nailing pins 82 wherever contact is made between ropes.

While subterranean post support 74 is illustrated with cross members to form a centrally positioned post aperture 80 it should be understood that many alternative grid designs are possible for making effective anchors according to this concept. For example, a plurality of hydrated lengths of concrete ropes can be woven into an interlaced or woven grid pattern of the type illustrated in FIG. 15. Such a design of hydrated concrete ropes can be formed in-situ at the construction site, some dry cement sprinkled on the points of contact and the rope members compressed together.

Post 70 is inserted into aperture 80 in lower tier 76 of in-ground hole 78, and the surrounding portions of the flexible hydrated cement rope manually compressed against the post sidewall to make intimate gripping contact while the rope is still flexible. While anchoring support 74 is still in a flexible hydrated state soil 84 is back filled over the support in lower tier 76 and tamped to compact the soil between and above the hydrated concrete ropes of the support. The weight of the compacted soil between supports serves to anchor the post and perform as a restraining block against lateral forces acting on the post.

Further supporting grids 74 should be employed in second or middle tier region 86 and upper or third tier region 88 of the in-ground hole in the manner disclosed above using hydrated concrete ropes for fabricating supports in situ so as to intimately engage post 70. With the addition of each support 74, soil 84 is back filled and tamped to provide further resistance to lateral and vertical movements. It is apparent the subterranean post supports have the important advantage of lower cost and the elimination of the major task of mixing large quantities of pourable concrete, otherwise normally required.

While subterranean post supports fabricated in-situ are preferred because of greater convenience and lesser risk of fracture to the support occurring during installation, the present invention also contemplates precast subterranean post supports, such as support 90 (FIG. 13). Precast rigid support 90 is but one example of a prefabricated design, which is also formed from multiple hydrated concrete ropes of various lengths. Support 90 consists of large outer body 92, inner hub 94 and spokes 96 connecting the outer body and inner hub. Support 90 is permitted to harden and cure into a one-piece rigid structure for transporting to the construction site for installation. It should be understood that post supports of other configuration can also be precasted, including those discussed above for fabrication in-situ.

Flexible concrete rope is especially useful as mortar rope in reinforcing brick, stone, rock, broken concrete pieces and block construction. FIG. 14 shows an end view of a culvert bridge 98 allowing vehicles and walkers to cross a drainage ditch 100 with a culvert pipe 102. Bridge 98 is constructed of crushed stone/rock 104. In order to stabilize and reinforce the stone construction, make the bridge substantially maintenance-free, and avoid stone avalanching downwardly to block the free drainage of water through culvert 102, various lengths of concrete ropes (1.25 to 7.6 cm) 106 filled, for example, with 1 part cement, 1½ parts sand and 2 parts A, A-1 stone aggregates are wetted in water for 2 to 3 minutes, and inserted by packing into crevices and spaces between stones 104 using a blunt tool. This allows for integration and stabilization of the stones making the bridge substantially maintenance-free.

FIG. 15 illustrates a grate 108 for a fireplace or grill woven from strips of concrete rope 110 as warp and filling strands. Grate 108 is assembled by first hydrating lengths of concrete rope and manually weaving the strips into an interlaced pattern. The flattened structure is allowed to dry and cure into a rigid structure. The concrete ropes employed should contain as an additive to Portland® cement and sand, lightweight aggregates manufactured from clays, particularly fire clays.

In addition to high temperature grates, specially prepared masonry mortar ropes can be fabricated with fire clay additives. Outdoor fireplace mortars for liners include a basic formula for elevated temperatures in the 1400°–1500° F. range with 1 part fire clay to 1 part Portland cement to 3 parts sand with minimal hydration with water. Higher temperature mixes in the range of 3000° F. are also commercially available.

In a manner similar to the fireplace and grill gates above, the present invention contemplates fencing and gates prepared from hydrated concrete ropes wetted and woven into an interlaced grid, and cured into a rigid structure.

Flexible concrete caulking ropes may also be used according to the methods described herein. They are useful when hydrated and pressed into a joint, for example between a driveway and house wall foundation. Other applications include chocks for dry foundations; reinforcements for deteriorated or damaged electrical poles; support and decorative pillars. By winding hydrated concrete rope co-axially several times about such structures it will reinforce the original structure and provide an inexpensive alternative to a more costly replacement.

While the invention has been described in conjunction with various embodiments, they are illustrative only. Accordingly, many alternatives, modifications and variations will be apparent to persons skilled in the art in light of the foregoing detailed description, and it is therefore intended to embrace all such alternatives and variations as to fall within the spirit and broad scope of the appended claims.

I claim:

1. An article of construction, which comprises an elongated outer textile casing in the form of a mono-tubular body with a continuous single bore running therethrough, said bore being filled with a dry cementitious material to provide a generally thin, flexible elongated rope-like article, said elongated outer textile casing being naturally permeable to water for controlled chemical hydration of said cementitious material therein.

2. The article of construction of claim 1 wherein said filled mono-tubular body is formed by removing compartmentalized bodies from a mat-like structure having a outer cloth shell subdivided into a plurality of connected parallel tubular bodies filled with dry cementitious material.

3. The article of construction of claim 1 wherein the dry cementitious material is a member selected from the group consisting of concrete mix and mortar mix.

4. The article of construction of claim 3 wherein the mix comprises at least one additive for enhanced thermal properties.

5. The article of construction of claim 3 wherein the mix comprises a fire clay.

6. The article of construction of claim 1 wherein said outer casing comprises a plurality of elongated cloth panels fastened together along parallel seams.

7. The article of construction of claim 1 wherein said outer casing comprises an elongated cloth panel folded together centrally in a direction running parallel with its longitudinal axis to form first and second connected panels, said folded panels being formed into a tubular body by sealing together along an outer edge.

8. The article of construction of claim 1 wherein said outer casing comprises a seamless one-piece tubular cloth body.

9. The article of construction of claim 1 wherein said outer casing is a member selected from the group consisting of cotton, jute, hemp, synthetic fibers and mixtures thereof.

10. The article of construction of claim 1 wherein said outer casing is muslin.

11. A subterranean support for a vertically positioned post comprising the article of construction of claim 1 wetted and arranged into a substantially planar grid structure having an aperture for receiving and supporting said post.

12. The subterranean post support of claim 11 wherein said grid is formed from the hydrated articles of construction and comprises spaced pairs of said articles of construction with each spaced pair being positioned in a plane running transverse to other spaced pairs of said articles of construction to provide the post aperture.

13. The subterranean post support of claim 12 wherein the transverse pairs of articles of construction are hydrated and woven into an interlaced pattern, and cured into rigid structure.

14. The subterranean support of claim 12 wherein the pairs of articles of construction are engaged and fastened together at their points of engagement.

15. A subterranean support for a vertically positioned post comprising the articles of construction of claim 1 hydrated, shaped and cured into a rigid structure comprising a generally outer rounded body, a post engaging hub substantially centrally positioned relative to said outer rounded body, and spokes connecting said hub and outer rounded body into a unitized structure.

16. The subterranean support of claim 15 wherein the outer rounded body is circular.

17. A caulking rope comprising the article of construction of claim 3.

18. A masonry mortar rope comprising the article of construction of claim 3.

19. A bridge structure constructed with a member selected from the group consisting of stone, rock, broken concrete pieces, brick and block reinforced with the masonry mortar rope of claim 18.

20. A fireplace grate comprising a plurality of the articles of construction of claim 4 hydrated and woven into an interlaced grid, and cured into rigid structure.

21. A grill grate comprising a plurality of the articles of construction of claim 4 hydrated and woven into an interlaced grid, and cured into rigid structure.

22. A fence panel comprising a plurality of the articles of construction of claim 1 hydrated and woven into an interlaced lattice, and cured into rigid structure.

23. A method of subterranean reinforcement of a post, which comprises the steps of:

(a) providing an in-ground hole with a greater diameter than that of the post;

(b) forming a first subterranean support in a lower tier of said in-ground hole by hydrating the articles of construction of claim 1 and shaping into a grid with an aperture for engaging the post;

(c) engaging the post and post aperture of said grid while adjusting the dimensions of said aperture for firm engagement of said post;

(d) partially back filling said in-ground hole with soil and tamping to compress said soil against said first support to provide anchoring and resistance against lateral forces, (e) forming at least one further grid support in said in-ground hole around said post at a second tier above said first support by repeating steps b–d, and (f) back filling said in-ground hole with additional soil and tamping.

24. The method of claim 23 wherein the articles of construction are shaped and cured into a prefabricated rigid structure comprising a generally outer rounded body, a post engaging hub substantially centrally positioned relative to said outer rounded body, and spokes connecting said hub and outer rounded body into a unitized structure.

25. A method of reinforcing bridging structures constructed from stone, rock, broken concrete pieces, brick and/or block which comprises the steps of:

(a) providing the masonry mortar rope of claim 19;

(b) cutting lengths of said masonry mortar rope to fit in crevices and joints between said adjacent stones, boulders, rocks, broken concrete pieces, bricks and/or blocks, and (c) hydrating said cut lengths of masonry mortar rope and wedging in said crevices and joints.

* * * * *